US008967983B2

(12) United States Patent
Kampf

(10) Patent No.: US 8,967,983 B2
(45) Date of Patent: Mar. 3, 2015

(54) SYSTEM FOR THE CONSTRUCTION OF AN AXIAL FAN

(75) Inventor: Lars Verner Kampf, Naestved (DK)

(73) Assignee: Novenco A/S, Naestved (DK)

( * ) Notice: Subject to any disclaimer, the term of this patent is extended or adjusted under 35 U.S.C. 154(b) by 383 days.

(21) Appl. No.: 13/498,733

(22) PCT Filed: Oct. 13, 2010

(86) PCT No.: PCT/DK2010/050266

§ 371 (c)(1),
(2), (4) Date: May 1, 2012

(87) PCT Pub. No.: WO2011/044910

PCT Pub. Date: Apr. 21, 2011

(65) Prior Publication Data

US 2012/0210572 A1 Aug. 23, 2012

(30) Foreign Application Priority Data

Oct. 13, 2009 (DK) ..... 2009 01119

(51) Int. Cl.

| | |
|---|---|
| ***F04B 17/03*** | (2006.01) |
| ***F04D 29/54*** | (2006.01) |
| ***F04D 25/08*** | (2006.01) |
| ***F04D 29/52*** | (2006.01) |
| ***F04D 29/60*** | (2006.01) |

(52) U.S. Cl.

CPC ..... *F04D 29/545* (2013.01); *F04D 25/08* (2013.01); *F04D 29/522* (2013.01); *F04D 29/601* (2013.01)

USPC ..... 417/360; 417/423.15

(58) Field of Classification Search

CPC .... F04D 29/522; F04D 29/545; F04D 29/601
USPC ..... 417/360, 423.15
See application file for complete search history.

(56) References Cited

U.S. PATENT DOCUMENTS

| | | | | |
|---|---|---|---|---|
| 2,494,772 | A | 1/1950 | McElroy | |
| 2,639,087 | A * | 5/1953 | Goede | 417/360 |
| 2,782,982 | A * | 2/1957 | Merz | 417/423.15 |
| 5,615,999 | A * | 4/1997 | Sukup | 415/182.1 |
| 5,797,731 | A * | 8/1998 | Kobayashi et al. | 417/238 |
| 6,220,830 | B1 | 4/2001 | Bzorgi | |
| 7,284,961 | B2 * | 10/2007 | Jacobsen | 417/53 |

(Continued)

FOREIGN PATENT DOCUMENTS

| | | |
|---|---|---|
| DE | 199 48 074 A1 | 4/2000 |
| GB | 881440 | 11/1961 |

(Continued)

OTHER PUBLICATIONS

International Search Report issued in International Application No. PCT/DK2010/050266 dated Mar. 29, 2011.

(Continued)

*Primary Examiner* — Charles Freay
(74) *Attorney, Agent, or Firm* — Oliff PLC

(57) ABSTRACT

A system for constructing an axial blower comprising an essentially circular-cylindrical blower pipe configured about a center axis and an inner pipe serving as motor case; and presenting several mounting options for mounting of motor drives to the effect that it is possible to mount motor drives extending rearwards relative to the inner pipe and motor drives extending primarily within the inner pipe.

16 Claims, 5 Drawing Sheets

(56) References Cited

U.S. PATENT DOCUMENTS

Figure 2:
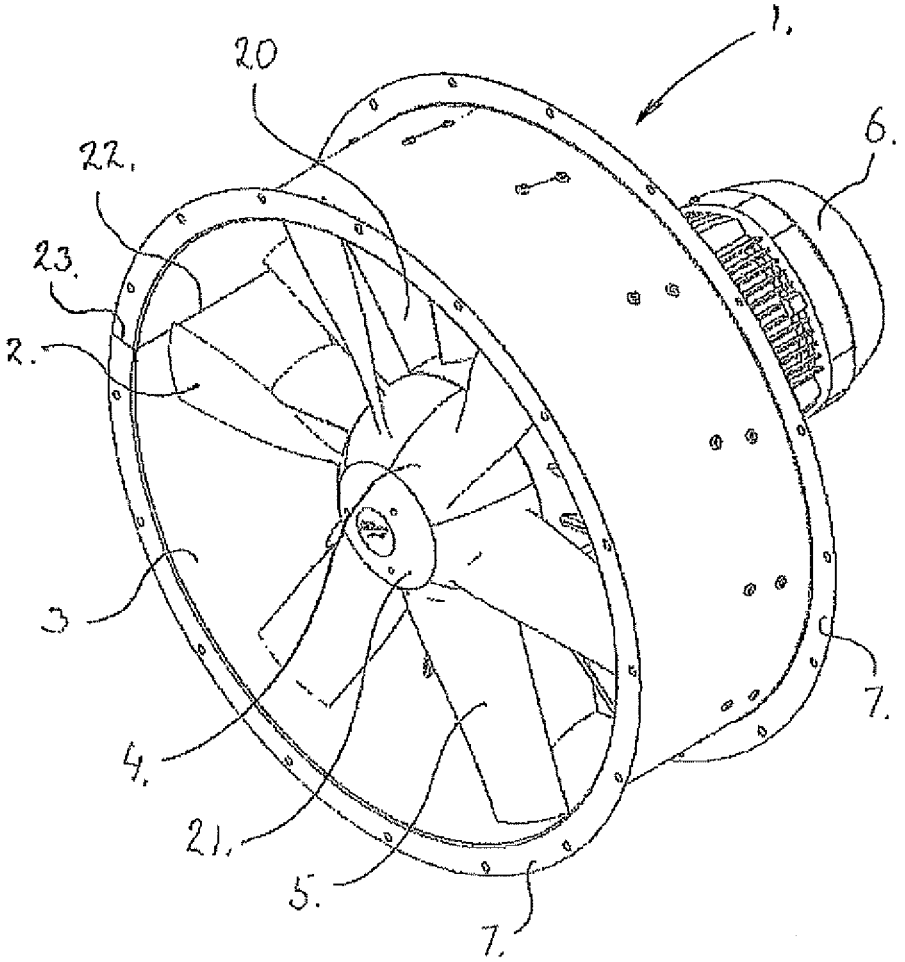
Figure 2:
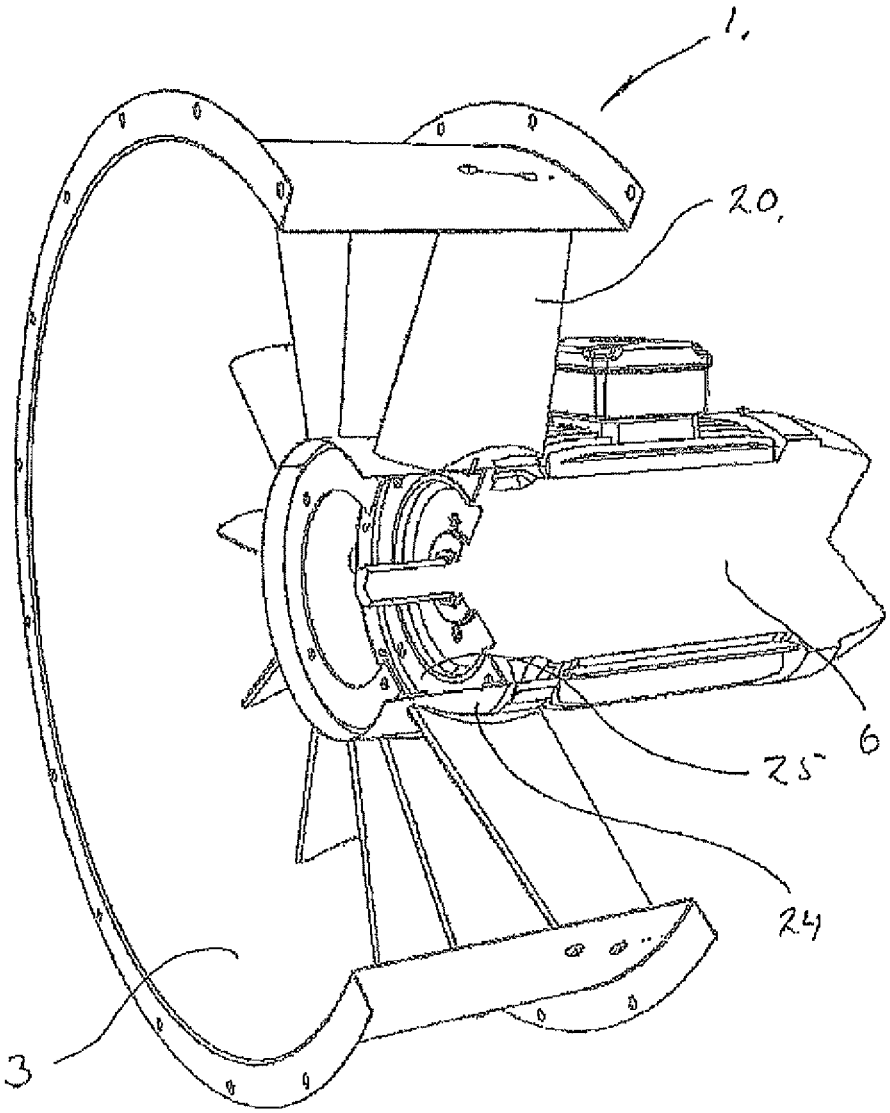

| | | | | |
|---|---|---|---|---|
| 2003/0206800 | A1 | 11/2003 | Mathson et al. | |
| 2011/0255239 | A1 * | 10/2011 | Franz | 361/679.48 |

FOREIGN PATENT DOCUMENTS

| | | |
|---|---|---|
| GB | 1010801 | 11/1965 |
| JP | A-57-142194 | 9/1982 |

OTHER PUBLICATIONS

Search Report issued in Danish Application No. 200901119 dated May 27, 2010 (with translation).

* cited by examiner

SYSTEM FOR THE CONSTRUCTION OF AN AXIAL FAN

FIELD OF USE OF THE INVENTION

The present invention relates to a system for the construction of an axial fan, said axial fan comprising a blower pipe configured about a centre axis and being essentially circular-cylindrical; wherein a fan rotor is configured, said fan rotor having a rotor hub essentially coinciding with the centre axis of the blower pipe and being arranged in extension of and connected to the drive shaft of a motor drive; and wherein, behind the fan rotor, a motor case is provided for mounting and retaining the motor drive, said motor case comprising an essentially circular-cylindrical inner pipe having a frontmost end facing towards the rotor hub and a rearmost end facing away from the rotor hub and being retained in the blower pipe by means of a number of ribs to the effect that the centre axis of the inner pipe coincides with the centre axis of the blower pipe; and wherein the motor case further comprises one or more mounting fittings configured for mounting of the motor drive to the inner pipe.

STATE OF THE ART

Today, several different embodiments of axial fans of the above-mentioned type are known, and they are generally used for being integrated into a tubing system, such as a ventilation system, where they serve the purpose of blowing air through the tubing system.

Thus, one example of a fan of the kind set forth above is known from U.S. Pat. No. 6,220,830.

It is thus a constant challenge in the development of such axial fans to achieve, on the one hand, that the axial fan has high efficiency to the effect that, in given conditions and at a given motor power for driving the fan rotor, a high pressure increase is achieved and/or a high air throughput, and, on the other hand, in particular for the sake of minimising costs to storage and mounting, that it is possible by use of relatively few constituent components to build different fans that are optimised for different operating conditions.

It is a problem in this context that it is possible to construct fans that have the same radius on the internal tube, but wherein the one fan has a fan rotor that requires a high drive force and hence a large motor drive in order for it to function optimally, but wherein the second fan has a rotor which, on its own, requires considerably less drive force.

OBJECT OF THE INVENTION

Based on that, it is the object of the present invention to provide a system of the kind set forth above, by which it is possible, by means of few constituent components to construct fans that are built for different operating conditions, while simultaneously a relatively high efficiency of the fans are maintained.

This is accomplished by means of a system of the kind set forth above and which is characterised in that the system comprises at least one small and one large motor drive, said motor drives being both configured for mounting on a mounting fitting; and where the largest dimension of the small motor drive measured at right angles to the centre axis of the drive shaft is smaller than the corresponding largest dimension on the large motor drive; and wherein the radius of the inner pipe on the inner side of the inner pipe is larger than the largest dimension on the small motor drive and smaller than the largest dimension on the large motor drive; and wherein the mounting fittings comprise a first fitting allowing the small motor to be mounted to the inner pipe such that at least the part of the small motor which has the larger dimension extends completely within the inner pipe, and a second fitting allowing the larger motor to be mounted to the inner pipe such that at least the part of the large motor which has the larger dimension extends completely behind the rearmost end of the inner pipe.

Thereby it is possible to obtain savings with regard to the number of different constituent components, since eg a given inner pipe and rotor hub can be used for constructing fans that require very different motor drives for driving the fan rotor at the intended speed of revolution. The small motor drive further not extending outside the inner pipe, seen from the front side of the axial fan, this contributes to a reduction of turbulence in the air flux in the axial fan in operation.

Particularly advantageously, the inner pipe and the first mounting fitting are configured such as to allow mounting of the first mounting fitting most proximate to the frontmost end of the inner pipe. Thereby, the distance from the relatively small drive motor to the rotor hub can be minimised to the effect that the shaft on the motor drive is strained as little as possible in operation.

In this context, the inner pipe and the second mounting fitting on which the large motor can be mounted can be configured such as to allow mounting of the second mounting fitting most proximate to the rearmost end of the inner pipe.

Moreover, the mounting fittings may further serve as an efficient bracing of inner pipe if they are provided with a circular outermost flange having the same outer radius as the inner radius of the inner pipe.

Particularly advantageously, the radius of the frontmost end of the inner pipe corresponds to the radius on the part of the rotor hub which is most proximate to the frontmost end of the inner pipe. Thereby, the risk of turbulence in the air flux in operation is reduced.

According to a further preferred embodiment, at least individual ones of the ribs are configured as guide faces for the air flowing in the axial fan.

LIST OF FIGURES

FIG. 1: is a perspective view of an axial fan, seen in an inclined view from the front and from above.

FIG. 2: is a sectional view showing a section of the axial fan according to FIG. 1.

Figure 3:
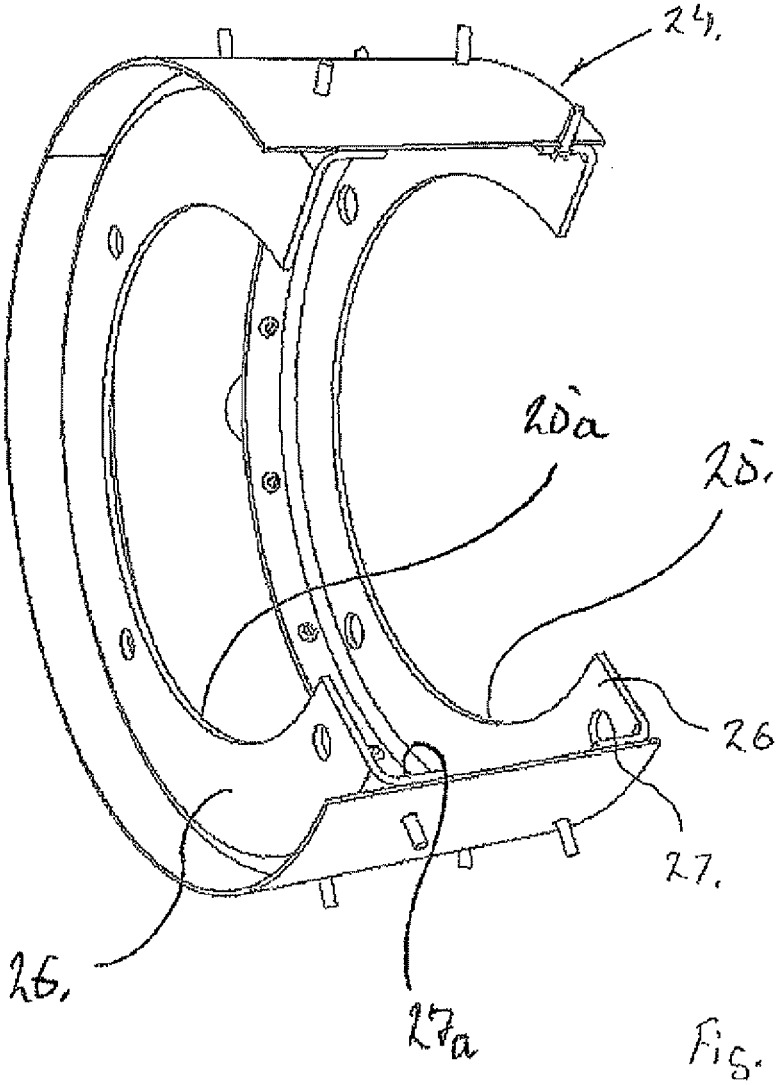

FIG. 3 is a sectional view showing a section of the motor case on the fan according to FIG. 2.

Figure 4:
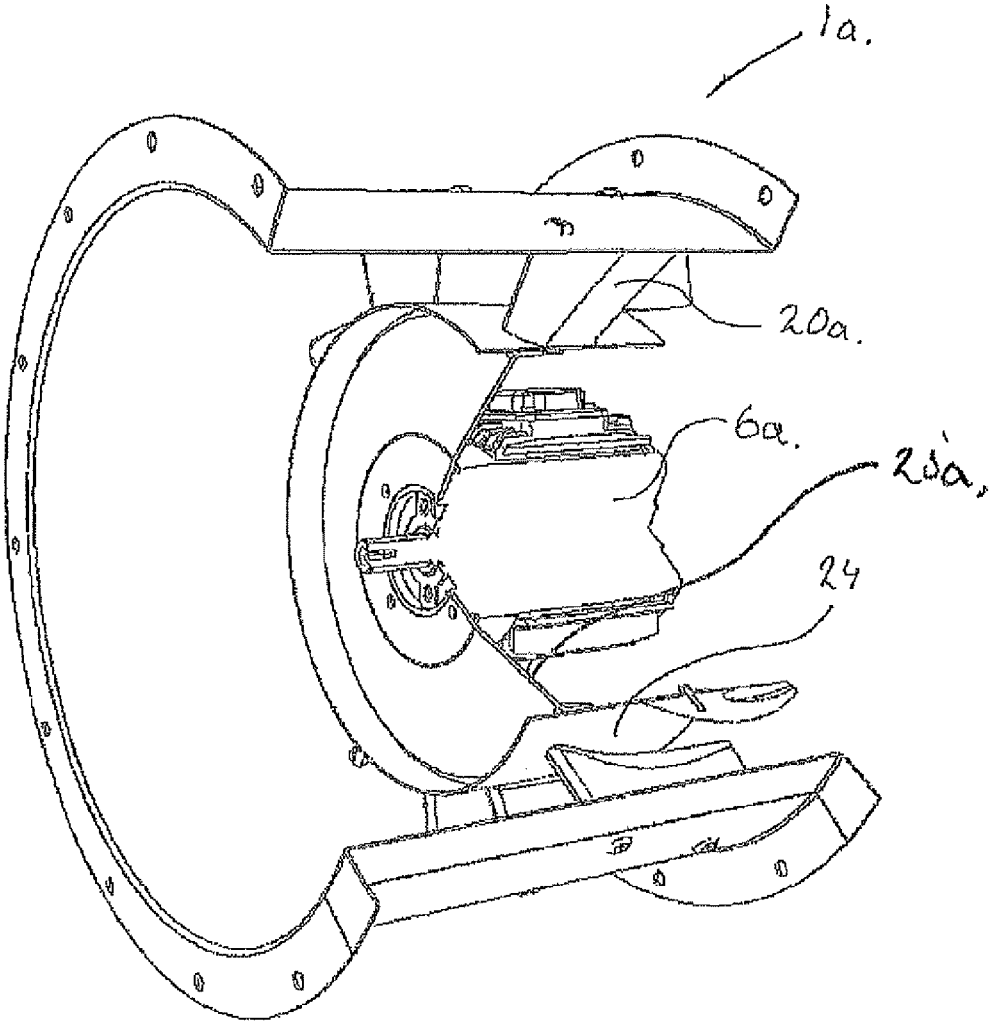

FIG. 4: is a sectional view showing a section of an alternative embodiment, compared to the one shown in FIG. 1, of an axial fan.

Figure 5:
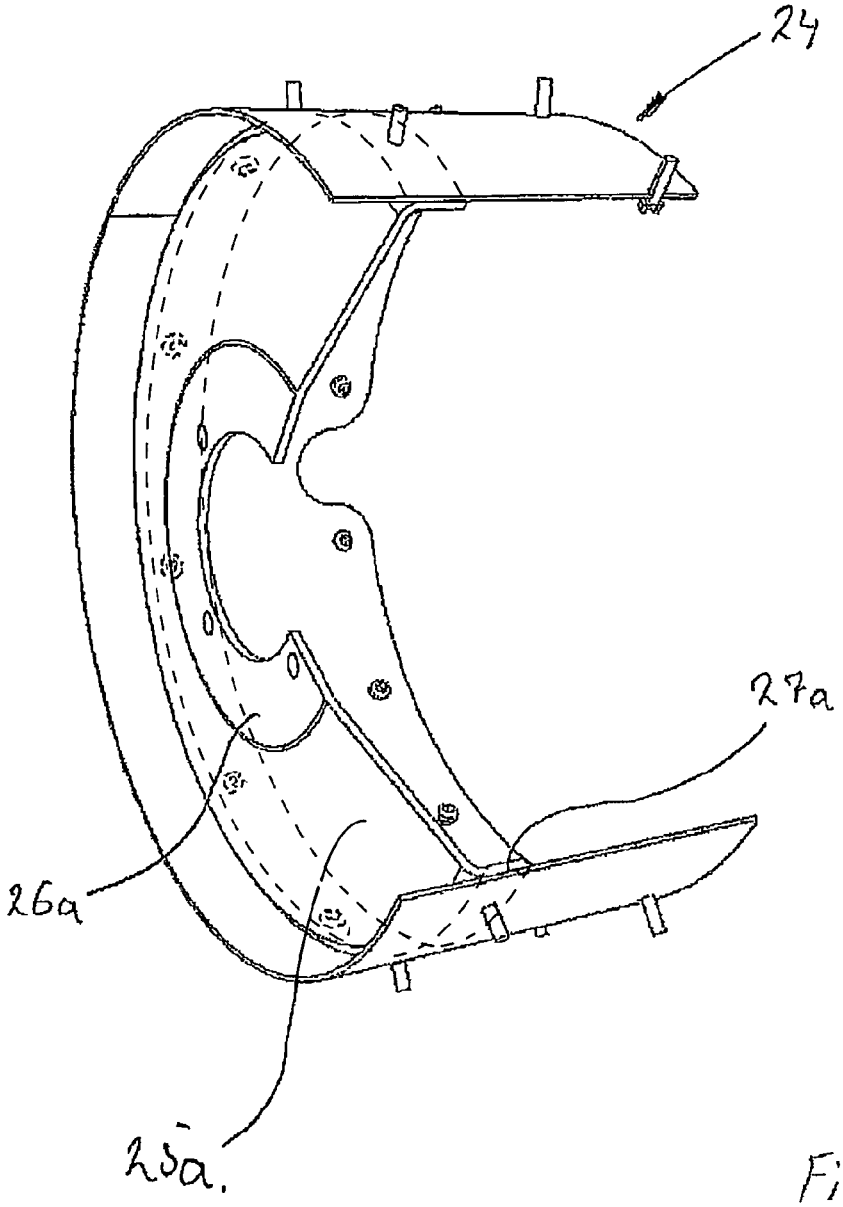

FIG. 5: is a sectional view showing a section of the motor case of the fan according to FIG. 4.

EMBODIMENT OF THE INVENTION

Thus, FIG. 1 shows an axial fan 1 according to the present invention, said axial fan 1 having a fan rotor 2 in the form of a propeller which is driven by a motor 6, said fan rotor 2 having a rotor hub 4 which is mounted to a not shown rotor shaft which is driven by the motor 6 about the centre axis of the rotor 2.

The rotor 2 is located centrally in a blower pipe 3 which has, at both its ends, a mounting flange 7 extending outwards from the blower pipe 3 and being provided with bolt holes for mounting of the axial fan 1 in a tubing system, such as a ventilation tubing system, where it serves to propel air through the tubing system.

Moreover, the rotor 2 has a set of rotor blades 5 extending radially outwards from the rotor hub 4 and out towards the blower pipe 3 where the rotor blades 5 end a short distance from the inner side of the blower pipe 3 to the effect that the smallest possible tip clearance is established between the outermost end of the rotor blades 5 and the inner side of the blower pipe 3.

The axial fan further features a motor case for mounting of the fan motor 6, which motor has an inner pipe 24 which is retained centrally in the blower pipe 3 by means of a number of ribs that, in the embodiment shown, further serve as guide faces for the air flowing in the axial fan in operation.

As will appear, the rotor hub 4 is configured such that it has its largest diameter arranged at its rearmost end, and the inner pipe 24 has a diameter which corresponds to the outermost diameter of the rotor hub.

FIGS. 2 and 4 now show two different embodiments of axial fans that have identical inner pipes 24, but wherein all other constituent components are different.

Thus, the fan shown in FIG. 1 is constructed with a large motor drive 6 which is mounted on the inner pipe 24 by means of a mounting fitting; and wherein the motor drive 6 works a fan rotor (not shown) having a relatively large external diameter.

The fan of FIG. 4 is shown in an alternative construction with a small motor drive 6*a* which is mounted in the inner pipe 24 by means of a second mounting fitting 25*a*, and wherein the motor drive 6*a* works a fan rotor (not shown) having a relatively small external diameter.

FIGS. 3 and 5 show the inner pipe 24 used for constructing both of the above-referenced axial fans, but wherein different mounting fittings are used for mounting the large and the small motor drives (6, 6*a*), respectively. It will appear that the mounting fittings 25, 25*a* are configured as rotational-symmetrical pieces that, arranged centrally, have a mounting flange 28 for mounting of a motor drive and having, outermost, a circular-cylindrical flange 27, 27*a* which is mounted by means of bolts to the inner side of the inner pipe 24.

By both axial fans 1, 1*a* above using the same centrally arranged inner pipe 24, it is enabled that the same rotor hub can also be used in both axial fans, without this giving rise to increased turbulence in the flux in the axial fan; and precisely the fan rotor being a comparatively expensive component in an axial fan, if it is to be optimised from a flow point of view to achieve a high efficiency of the fan, it is very advantageous that the same rotor hub 4 can be used in several configurations of axial fans 1, 1*a*.

The invention claimed is:

1. A kit for construction of an axial fan system in a duct, comprising:

an essentially circular-cylindrical blower pipe configured about a centre axis, including a fan rotor that is configured within the blower pipe, the fan rotor: (1) having a rotor hub that essentially coincides with the centre axis of the blower pipe, and (2) being connected to and extending from a drive shaft in a motor drive;

a motor case that is provided behind the fan rotor for mounting and retaining the motor drive, said motor case including:

an essentially circular-cylindrical inner pipe having a frontmost end facing towards the rotor hub and a rearmost end facing away from the rotor hub, and being retained in the blower pipe by means of a number of ribs to the effect that the centre axis of the inner pipe coincides with the centre axis of the blower pipe, and one or more mounting fittings configured for mounting of the motor drive to the inner pipe, and at least one small motor drive and at least one large motor drive, the at least one small motor drive and the at least one large motor drive being both configured for mounting on a mounting fitting, and a largest dimension of the at least one small motor drive measured at right angles to the centre axis of the drive shaft is smaller than a corresponding largest dimension on the at least one large motor drive, wherein:

a radius on an inner side of the inner pipe is larger than the largest dimension of the at least one small motor drive and smaller than the largest dimension of the at least one large motor drive, and the mounting fitting includes:

a first fitting allowing the small motor to be mounted to the inner pipe such that at least the part of the at least one small motor which has the larger dimension extends completely within the inner pipe, and a second fitting allowing the at least one large motor to be mounted to the inner pipe such that at least the part of the at least one large motor which has the larger dimension extends completely behind the rearmost end of the inner pipe.

2. The kit according to claim 1, wherein the inner pipe and the first mounting fitting are configured such as to allow mounting of the first mounting fitting most proximate to the frontmost end of the inner pipe.

3. The kit according to claim 1, wherein the inner pipe and the second mounting fitting are configured such as to allow mounting of the second mounting fitting most proximate to the rearmost end of the inner pipe.

4. The kit according to claim 3, wherein at least one of the mounting fittings has a circular outermost flange having the same outer radius as the inner radius on the inner pipe to the effect that the mounting fitting braces the inner pipe following mounting therein.

5. The kit according to claim 1, wherein the radius of the frontmost end of the inner pipe corresponds to the radius on that part of the rotor hub which is most proximate to the frontmost end of the inner pipe.

6. The kit according to claim 1, wherein at least individual ones of the ribs are configured as guide faces for the air flowing in the axial fan.

7. The kit according to claim 2, wherein the radius of the frontmost end of the inner pipe corresponds to the radius on that part of the rotor hub which is most proximate to the frontmost end of the inner pipe.

8. The kit according to claim 3, wherein the radius of the frontmost end of the inner pipe corresponds to the radius on that part of the rotor hub which is most proximate to the frontmost end of the inner pipe.

9. The kit according to claim 4, wherein the radius of the frontmost end of the inner pipe corresponds to the radius on that part of the rotor hub which is most proximate to the frontmost end of the inner pipe.

10. The kit according to claim 2, wherein at least individual ones of the ribs are configured as guide faces for the air flowing in the axial fan.

11. The kit according to claim 3, wherein at least individual ones of the ribs are configured as guide faces for the air flowing in the axial fan.

12. The kit according to claim 4, wherein at least individual ones of the ribs are configured as guide faces for the air flowing in the axial fan.

13. The kit according to claim 5, wherein at least individual ones of the ribs are configured as guide faces for the air flowing in the axial fan.

14. The kit according to claim 7, wherein at least individual ones of the ribs are configured as guide faces for the air flowing in the axial fan.

15. The kit according to claim 8, wherein at least individual ones of the ribs are configured as guide faces for the air flowing in the axial fan.

16. The kit according to claim 9, wherein at least individual ones of the ribs are configured as guide faces for the air flowing in the axial fan.

* * * * *